United States Patent [19]

Neale, Sr.

[11] 4,075,417

[45] Feb. 21, 1978

[54] CRIMPED, INSULATION PIERCING ELECTRICAL CONNECTION

[75] Inventor: Dory J. Neale, Sr., St. Petersburg, Fla.

[73] Assignee: The National Telephone Supply Company, Cleveland, Ohio

[21] Appl. No.: 667,505

[22] Filed: Mar. 17, 1976

[51] Int. Cl.[2] ..... H01R 5/10

[52] U.S. Cl. ..... 174/84 C; 29/629; 339/98

[58] Field of Search ..... 174/84 C, 88 R; 339/97 C, 98; 29/628, 629, 630 F

[56] References Cited

U.S. PATENT DOCUMENTS

| | | | |
|---|---|---|---|
| 3,320,354 | 5/1967 | Marley et al. | 174/84 C |
| 3,814,836 | 6/1974 | Neale, Sr. | 174/84 C |

*Primary Examiner*—Laramie E. Askin

*Attorney, Agent, or Firm*—Fishburn, Gold & Litman

[57] ABSTRACT

A connector for electrically joining insulated conductors without removing the insulation therefrom. The connector is generally channel-shaped having a web with opposed, spaced apart side walls extending therefrom, and includes an electrically conductive inner portion, ultrasonically bonded to an electrically insulative outer portion. Rows of conductor engaging protuberances are disposed transversely on the side walls, each of said rows having a plurality of protuberances with a spacing between adjacent edges thereof, for receiving one of the conductors therebetween. Said spacing is smaller than the width of a conductor and is graduated such that the spacing gradationally decreases in width from those rows adjacent the connector ends to those rows intermediate of said connector. The connector, which is preferably formed with other identical connectors in elongated strips for use with automatic crimping machines, receives conductors between the walls thereof and, in response to crushing force applied thereon, the protuberances penetrate the insulation and engage the conductor to hold same and make electrical contact therewith.

10 Claims, 12 Drawing Figures

CRIMPED, INSULATION PIERCING ELECTRICAL CONNECTION

This invention relates to electrical connectors for insulated conductors, and more particularly to an improved connector which is generally channel-shaped and is crimped onto insulated wire, with members thereon to penetrate the insulation and make electrical contact with the wire or cord therein. The connector is preferably formed with other identical connectors in elongated strips for use with automatic crimping machines such as that disclosed in Neale, U.S. Pat. No. 3,886,642.

The principal objects of the present invention are: to provide an improved connector for electrical conductors wherein an electrically conductive inner portion is ultrasonically bonded to an electrically insulative outer portion so as to form an integral structure which alleviates electrical shorting between adjacent connectors; to provide such a connector wherein a spacing between adjacent protuberances gradationally decreases in width from the rows adjacent the connector ends to the rows intermediate of the connector for increasing the mechanical strength of the connection; to provide such a connector wherein at least one wire support member, protruding upwardly between the connector side walls, positions the conductors within a protuberance engaging area of the connector to insure maximum engagement therebetween; to provide such a connector wherein the ends of the connector outer portion extend longitudinally beyond the inner portion and are bent inwardly for improved connector insulative integrity; to provide such a connector wherein the connector inner portion is coated with indium to alleviate the oxidation of aluminum conductors engaged therein; to provide such a connector wherein the body is adapted to be filled with a sealant when same is crimped, to form an air and moisture tight structure enclosing the electrically connected conductors; to provide such a connector which is adapted to be manufactured in an elongate chain, the connectors being removably attached in an end-to-end fashion; and to provide such a connector which is economical to manufacture, efficient in use, and capable of long operating life and particularly well adapted for the proposed use.

Other objects and advantages of this invention will become apparent from the following description taken in connection with the accompanying drawings wherein are set forth, by way of illustration and example, certain embodiments of this invention.

Figure 2:
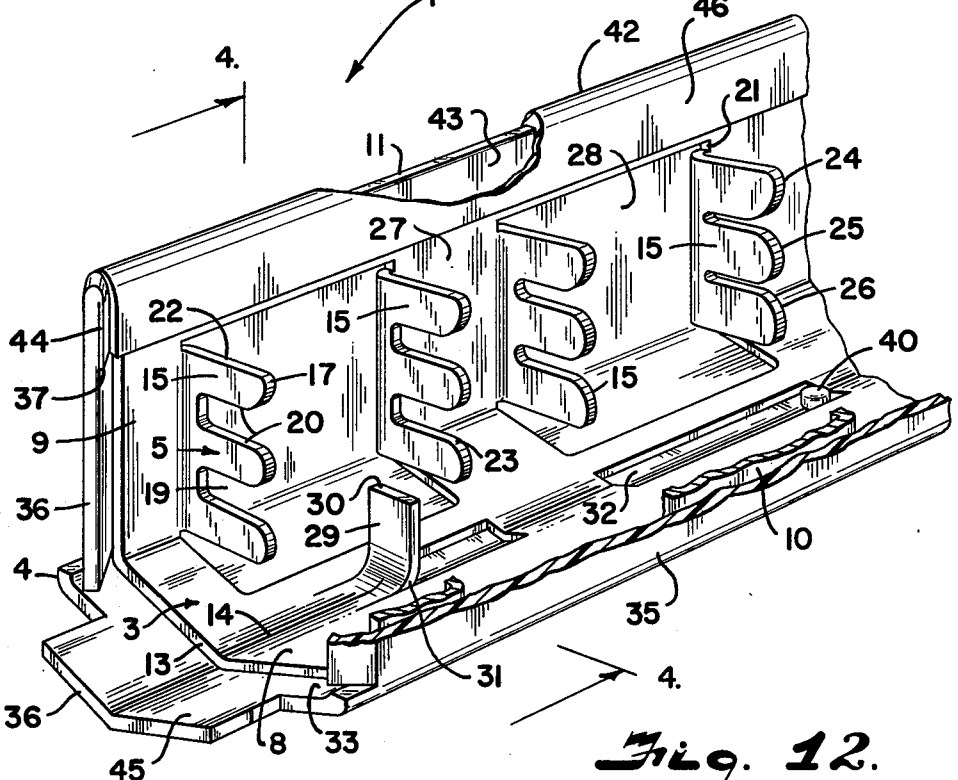
FIG. 2 is a fragmentary enlarged perspective view of the connector taken from one end thereof to a medial portion thereof and having portions thereof broken away particularly showing a wire support structure and the interconnection of the two connector portions.

Referring more in detail to the drawings:

The reference numeral 1 generally designates a connector for mechanically and electrically joining two or more insulated conductors 2. The connector 1 is comprised of an electrically conductive inner portion 3 which is bonded to an electrically insulative outer portion 4. The connector inner portion 3 has rows of conductor engaging protuberances 5 which, upon connector crimping, penetrate the insulation 6 of the conductors and engage the core 7 thereof to effect an electrical and mechanical connection therebetween.

The connector inner portion 3 is generally channel-shaped, having a web 8 with opposed, spaced apart, upstanding side walls 9 and 10 respectively having outer edges 11 and 12 extending therefrom in a substantially parallel relation. The inner portion 3 further includes end edges 13 and a fold line 14 about which the connector walls are crimped together. In the illustrated structure, the web 8 is transversely V-shaped and the bottom of same is centrally disposed along fold line 14 to facilitate the easy and accurate crimping of the connector 1 onto the conductors 2. The protuberances 5 are arranged in rows 15 thereof, a plurality of which extend preferably inclined inwardly from the adjacent connector end, from each inner portion side wall 9 and 10. The protuberances 5 are substantially equal in length and form between the ends 17 thereof an insert opening or aperture 18 (see FIG. 9) into which the conductors 2 are positioned prior to connector crimping.

Each protuberance row 15 includes a plurality of interconnected protuberances 5 having a spacing 19 between the side edges 20 of adjacent protuberances. Each protuberance row 15 is connected with one of the inner portion side walls 9 or 10 along a straight, longitudinal edge 21. In the illustrated structure, each protuberance row 15 is integral with the connector inner portion, along edge 21, and includes end edges 22 and curvilinear edge 23 which form three integral protuberances 24, 25 and 26. Further, in this example, the protuberance rows 15 are formed in pairs, being pierced and bent opposingly upwardly from sheet material, thereby forming an alternating succession of rib segments 27 and apertures 28.

The spacing 19 between each protuberance 5 is smaller in width than that of the conductor core 7, such that each engaging protuberance edge contacts said core. For example, the spacing for a connector adapted to engage conductors having a core diameter of approximately 0.019 inch, is in the nature of 0.015 inch. In the illustrated structure, said spacing 19 gradationally decreases in width from the rows adjacent the inner portion end edges 13 to the rows intermediate of said connector 1 to provide an improved mechanical joining of the conductors 2. The protuberance rows 15 on inner portion side wall 9 are slightly, longitudinally offset from the mating protuberance rows of side wall 10, whereby during connector crimping, the conductors 2 are engaged by said rows 15 in a scissors-like fashion. Further, the protuberance ends 17 and spacing 19 of side walls 9 and 10 are aligned to facilitate conductor engagement.

At least one conductor support member 29 is attached to said inner portion web 8, and extends upwardly between side walls 9 and 10 and interjacent the protuberance rows 15. The conductor support member 29 includes an upper edge 30 adapted to support a conductor 2 thereon to transversely space same within the wire insert aperture 18 (see FIG. 9) to insure protuberance engagement. In the illustrated structure, a support member 29 is provided adjacent each end of the connector inner portion 3, having one end 31 thereof integral with said inner portion. Each support member 29 is substantially parallel to the protuberance rows 15 and extends upwardly therebetween with the upper edge 30 thereof planar with the upper side edge 20 of the innermost protuberance 26. In the illustrated structure, a plurality of elongated apertures 32 extending through said connector inner portion 3 is disposed along fold line 14 and facilitates connector crimping thereabout. In this example, the apertures 28 between the protuberance rows 15, extend into the inner portion web 8 to prevent connector springback after crimping.

Figures 4, 5, 6, 7, 8, 9, 10, 11:
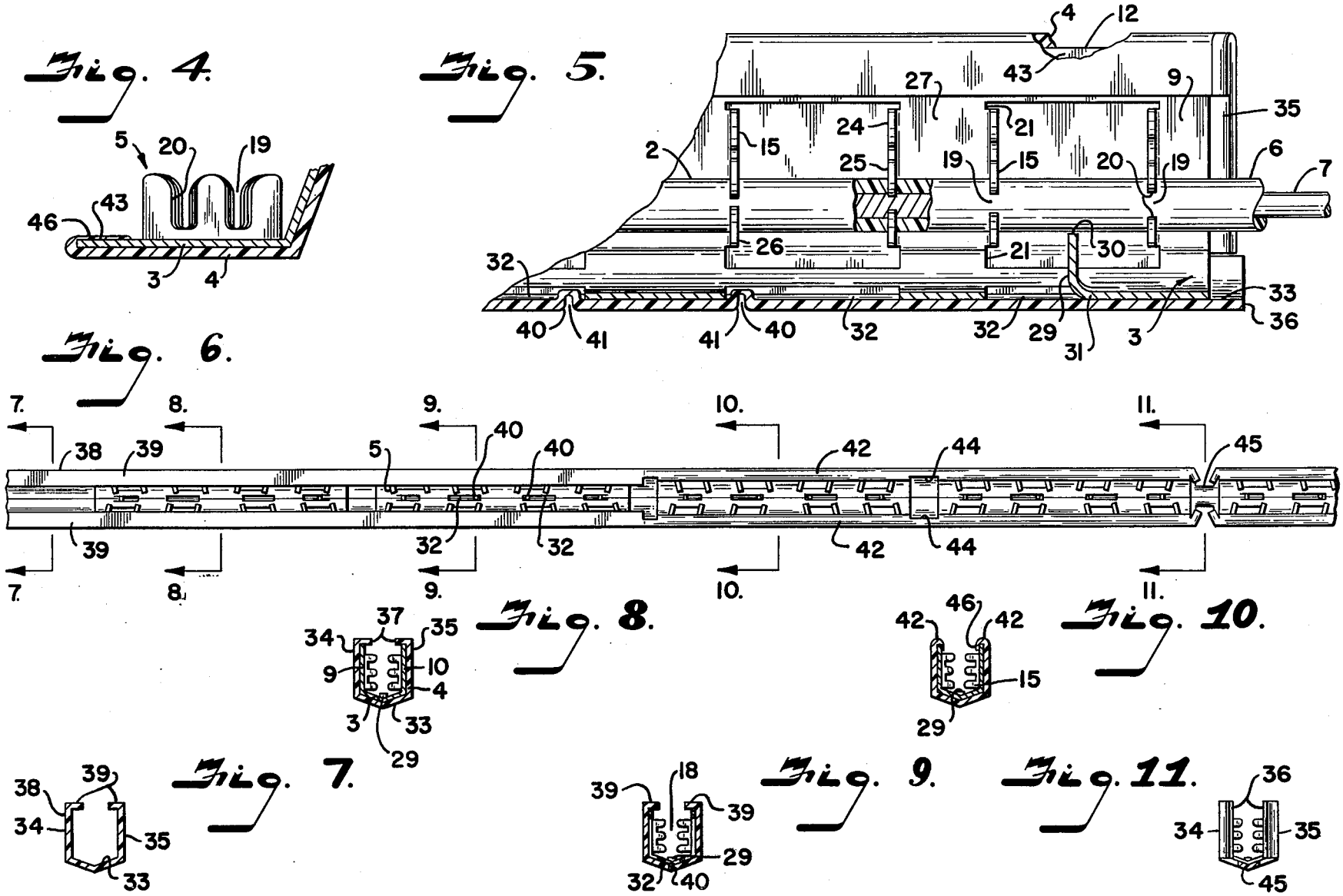
FIG. 4 is a fragmentary cross-sectional view of the connector taken along line 4—4 of FIG. 2, particularly showing the gradationally spaced protuberances.
FIG. 5 is an enlarged fragmentary cross-sectional view of the connector, taken from the medial portion thereof to the other end thereof, and an insulated conductor engaged therein.
FIG. 6 is a top plan view of an elongated strip of connectors, shown in the various steps of manufacture.
FIG. 7 is a cross-sectional view of the strip taken along line 7—7, FIG. 6.
FIG. 8 is a cross-sectional view of the strip taken along line 8—8, FIG. 6.
FIG. 9 is a cross-sectional view of the strip taken along line 9—9, FIG. 6.
FIG. 10 is a cross-sectional view of the strip taken along line 10—10, FIG. 6.
FIG. 11 is a cross-sectional view of the strip taken along line 11—11, FIG. 6.

As can best be seen in FIG. 6, the protuberances 5 are preferably inclined inwardly. The inclination of the protuberances 5 is away from the connector end adjacent thereto, and causes same to bend inwardly during crimping thus pulling the engaged conductors further into the connector so as to secure the connection. The connector inner portion 3 is preferably constructed of a ductile, highly conductive metal such as copper, brass, Phosphor-bronze, or the like. When the connector 1 is used to join two or more conductors 2 having aluminum cores 7, a layer of nonoxidizing, solid, conductive material, such as indium, preferably coats the connector inner portion 3 so as to minimize aluminum oxide formation and resultant connector electrical resistance.

Figure 12:
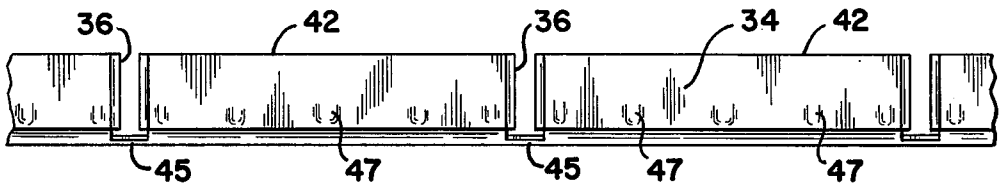
FIG. 12 is a fragmentary side elevational view of the strip.
Figure 1:
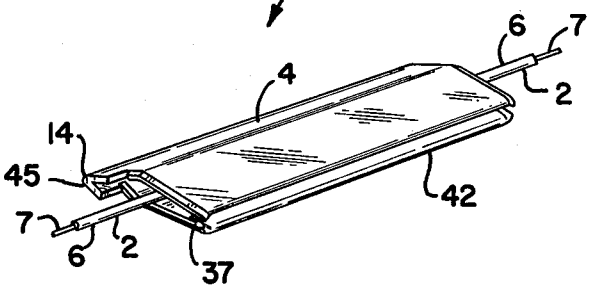
FIG. 1 is a perspective view of a connector embodying the present invention, with insulated conductors crimped therein.
Figure 3:
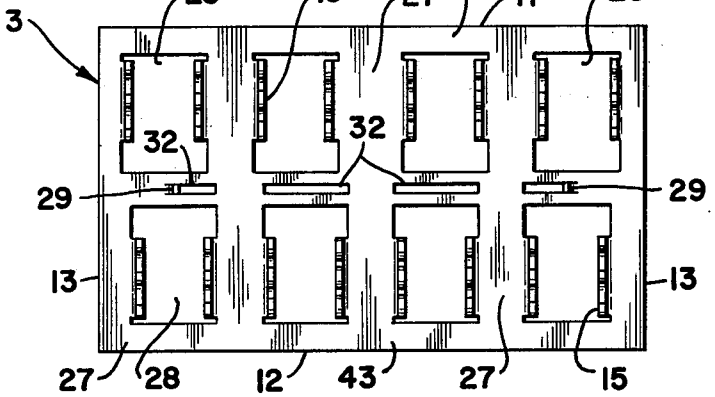
FIG. 3 is a top plan view of a partially formed blank for producing the connector inner portion.

The connector outer portion 4 is a generally channel-shaped structure having a web 33 and side walls 34 and 35 which mate with and respectively overlie the inner portion web 8 and side walls 9 and 10. The outer portion includes end edges 36 and side wall outer edges 37. The connector outer portion 4 is preferably constructed of a thin layer or film of suitable imperforate material such as polyvinylchloride, Mylar (polyethylene terephthalate), or the like. The outer portion 4 is preferably formed by extruding an elongate segment of such material into a generally U-shape channel 38 which, as illustrated in FIG. 7, includes web 33, side walls 34 and 35, and lip portions 39. The inner portion 3 is centeringly inserted into the U-shaped channel 38 a predetermined spaced distance from the adjacent connector (FIG. 8), and a projection 40 is formed extending upwardly into an inner portion aperture to maintain the relative longitudinal positioning of the inner and outer connector portions. As can best be seen in FIG. 5, the projections 40 are imperforate, as aperture 41 of outer portion web 33 does not extend through the U-shaped channel 38, to prevent moisture and/or air to penetrate the connection. In this example, two projections 40 extend into a portion of centrally disposed elongated fold apertures 32. The connector outer portion 4 is then bonded by any suitable means, preferably ultrasonic welding, to the exterior surface of inner portion web 8 and side walls 9 and 10, to form an electrically insulative external cover therefor. After said ultrasonic welding, the outer portion side walls 34 and 35 are conformingly shaped around inner portion ribs 27, and are depressed slightly inwardly into apertures 28, as shown in FIG. 12, to form protrusion 47 in said side walls. The lip portions 39 are formed over the inner portion outer edges 11 and 12 respectively, forming outer connector edges 42, with the outer portion outer edges 37 bonded to an interior surface 43 of the inner portion, adjacent the side edges 20 of the uppermost protuberance 24. The outer portion end edges 37 overlappingly extend beyond inner portion end edges 13. That portion 44 of the outer portion outer edge extending longitudinally beyond the inner portion end edges 13, is fused to the outer portion, thereby preventing relative longitudinal translation between the inner and outer connector portions. The U-shaped channel 38 is then formed into a plurality of interconnected connectors 1, by transversely cutting through a major portion of the channel, thereby leaving a small tab portion 45 adjacent the bottom of the web 33 to join the connector outer portions 4. Preferably, simultaneously with the transverse cutting of the U-shaped channel, that portion of the outer portion end edges 36 not being part of the tab 45 is formed inwardly at an angle to the side walls 34 and 35 to improve the mechanical connection of the inner and outer connector portions and to improve the electrical insulation of said connection. The forming and bonding of the outer portion walls 34 and 35, as well as the fusing of the end edges 42, are preferably performed by ultrasonic welding techniques. As can best be seen in FIG. 4, the outer wall portion 46 overlying the interior surface 43 of the inner portion 3, is preferably very thin so as not to obstruct connector crimping and conductor engagement. In use with automatic crimping machines, it is particularly important to minimize the thickness of outer wall portion 46, to facilitate the withdrawal of machine fingers therefrom while same is in a partially crimped condition. Yet, the wall portion 46 must be securely attached to the outer portion 4, preferably integrally, to securely encase the inner portion and provide insulative integrity therefor. Ultrasonic welding is particularly adapted for this application in that the lip portions 39 are, by ultrasonic welding techniques, formed downwardly over the inner portion outer edges and pressed into a thin, nonobstructive outer wall portion 46 which is bonded to interior surface 43. For example, if the outer portion thickness is 0.018 inch before welding, the outer wall portion is formed to a thickness in the nature of 0.005 inch, which is adequate to provide the connector with proper strength and insulative characteristics.

In use, the conductors 2, which are to be spliced together, are first cut to predetermined lengths and then inserted into connector aperture 18. The abutting contact of the conductors 2 with the conductor support members 29 will prevent the conductors from evading engagement with the protuberance edges by falling into the connector's web portion. Transverse force is applied to the connector side walls 34 and 35 by clamping means, such as an automatic crimping machine, convergingly translating same into a crimped condition about the conductors. The protuberance side edges 20 penetrate the conductor insulation 6 and engage the core 7 thereof as said conductor is forced into the protuberance spacing 19. A viscous, pressure flowable, inert insulating material (not shown) such as silica gel, putty, or the like is used to fill the interior of the connector to form a substantially solid encapsulation of the connector and conductors engaged therein, thereby providing a structure substantially impervious to air, moisture, and other atmospheric conditions.

What I claim and desire to secure by Letters Patent is:

1. An electrical connection of conductors having insulation thereon comprising:

(a) a generally channel-shaped connector having a web with opposed, spaced apart side walls extending therefrom;

(b) said connector including an electrically conductive inner portion bonded to an electrically insulative outer portion;

(c) said connector inner and outer portions respectively including end portions, a web, and side walls having free longitudinal edges and transverse end edges;

(d) rows of conductor engaging protuberances on the inner portion side walls being disposed transversely thereof; each of said rows having a plurality of said protuberances with a spacing between adjacent protuberance edges for receiving one of said conductors therebetween;

(e) said spacing being smaller than the width of a conductor and being graduated such that the spacing gradationally decreases in width from the rows adjacent said connector ends to the rows intermediate of said connector; and (f) said conductors having portions thereof clamped between the walls of said connector, and said protuberance edges penetrating into the insulation of said conductors therebetween to hold said conductors and to make electrical contact therewith.

2. An electrical connection as set forth in claim 1 wherein:

(a) said outer portion end edges overlappingly extend from said inner portion end edges in a spaced apart relation thereto; and (b) said outer portion walls are molded over said inner portion free edges with the outer portion free edges being bonded to first and second inner, upper surfaces of said inner portion.

3. An electrical connection as set forth in claim 2 wherein:

(a) the outer portion end edges adjacent said first and second inner upper surfaces of said inner portion are fused together; and (b) overlapping ends of said outer portion side walls are molded inwardly at an obtuse angle thereto and are adapted for sealing, abutting contact therebetween.

4. An electrical connection as set forth in claim 3 wherein:

(a) at least one wire support tab is centrally attached to said connector web, extending substantially normally thereto between said connector walls and between adjacent protuberance rows, to adjacent an innermost column of protuberances; and (b) said support tab abuttingly contacts said conductors assuring the engagement of said protuberance edges and said conductors.

5. An electrical connection as set forth in claim 4 wherein:

(a) the rows of protuberances on each of said connector side walls are respectively aligned with a longitudinal offset such that the protuberance edges engage said conductors with a scissor-like clamp; and (b) said protuberances curve away from an adjacent end of said connector to hold said conductors and make electrical contact therewith.

6. An electrical connection as set forth in claim 5 wherein:

(a) said connector inner portion is constructed of metal; and (b) said metallic inner portion has a layer of indium bonded thereto.

7. An electrical connection as set forth in claim 1 wherein:

(a) at least one wire support tab is centrally attached to said connector web, extending substantially normally thereto between said connector walls and between adjacent protuberance rows, to adjacent an upper side edge of an innermost protuberance; and (b) said support tab abuttingly contacts said conductors assuring the engagement of said protuberance edges and said conductors.

8. An electrical connection as set forth in claim 1 wherein:

(a) the rows of protuberances on each of said connector side walls are respectively aligned with a longitudinal offset such that the protuberance edges engage said conductors with a scissor-like clamp; and (b) said protuberances curve away from an adjacent end of said connector to hold said conductors and make electrical contact therewith.

9. An electrical connection as set forth in claim 1 wherein:

(a) said connector inner portion is constructed of metal; and (b) said metallic inner portion has a layer of indium bonded thereto.

10. An electrical connection as set forth in claim 1 wherein:

(a) said inner and outer portion webs are V-shaped, respectively having a pair of inclined walls which intersect along a central fold line; and (b) a plurality of longitudinally aligned slots extend through said conductor inner portion along said central fold line thereof to facilitate crimping the connector onto said conductors.

* * * * *